United States Patent [19]

Finger et al.

[11] Patent Number: 4,678,892

[45] Date of Patent: Jul. 7, 1987

[54] COMBINATION CLEANER SAFETY CIRCUIT

[75] Inventors: John F. Finger; Glen A. Lawrenson, both of Beresford, S. Dak.

[73] Assignee: Sioux Steam Cleaner Corporation, Beresford, S. Dak.

[21] Appl. No.: 785,341

[22] Filed: Oct. 7, 1985

[51] Int. Cl.[4] ..... H05B 1/02; F24H 1/08

[52] U.S. Cl. ..... 219/272; 219/332; 122/504

[58] Field of Search ..... 219/271, 272, 273, 276, 219/362, 332; 239/133, 135, 136; 122/4 A, 13 A, 504

[56] References Cited

U.S. PATENT DOCUMENTS

| | | | |
|---|---|---|---|
| 1,480,174 | 1/1924 | Matthews | 219/332 |
| 2,295,228 | 9/1942 | Malsbary et al. | 122/448 R |
| 2,345,614 | 4/1944 | Malsbary et al. | 239/75 |
| 2,627,015 | 1/1953 | Hackman | 219/330 |
| 2,755,130 | 7/1956 | Arant | 239/137 |
| 2,861,838 | 11/1958 | Wyatt et al. | 239/137 |
| 3,025,381 | 3/1962 | Pickering | 219/272 |
| 3,365,567 | 1/1968 | Smith | 219/272 |
| 3,485,176 | 12/1969 | Telford | 239/135 |
| 3,814,321 | 5/1974 | Mulholland et al. | 239/135 |
| 4,217,924 | 12/1977 | Finger | 137/334 |
| 4,484,062 | 11/1984 | Estevez | 219/332 |

FOREIGN PATENT DOCUMENTS

| | | | |
|---|---|---|---|
| 2212448 | 9/1973 | Fed. Rep. of Germany | 219/362 |

OTHER PUBLICATIONS

Sioux Corporation brochure.
Alkota Manufacturing, Inc., brochure.

*Primary Examiner*—E. A. Goldberg
*Assistant Examiner*—Teresa J. Walberg
*Attorney, Agent, or Firm*—Merchant, Gould, Smith, Edell, Welter & Schmidt

[57] ABSTRACT

A safety control circuit for an electric combination cleaner includes an on-delay relay (18) operatively coupled with the motor start relay (16) together with an off-delay relay (40) operatively coupled with the start switch (30) and the pump motor relay to provide automatic predetermined time delays upon start-up and shutdown to avoid overheating and thus damage to the equipment.

7 Claims, 1 Drawing Figure

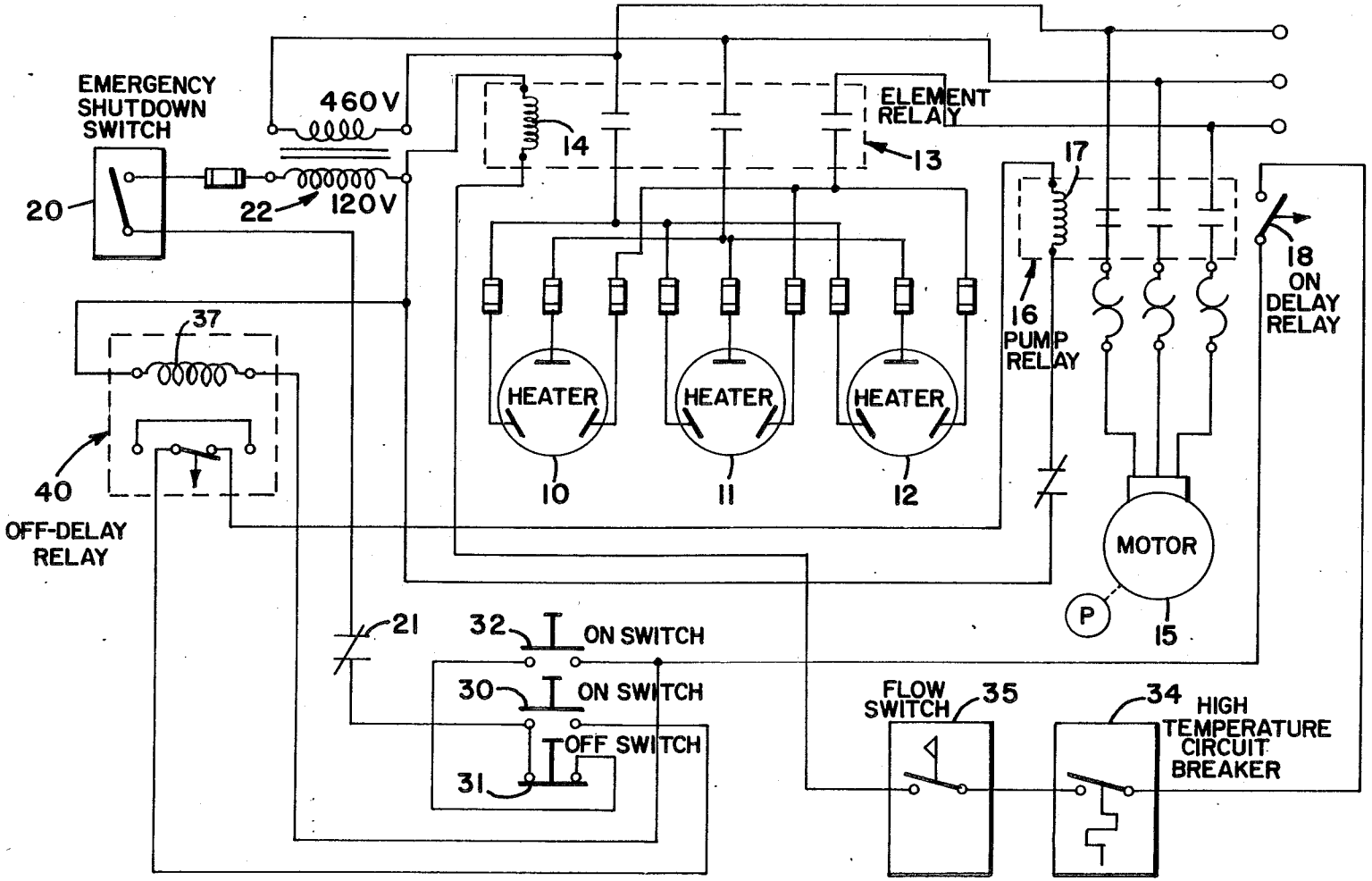
18
ON
DELAY
RELAY
MOTOR
15
P
17
16
PUMP
RELAY
ELEMENT
RELAY
13
HEATER
12
HEATER
11
HEATER
10
14
460 V
120 V
22
EMERGENCY
SHUTDOWN
SWITCH
20
37
40
OFF-DELAY
RELAY
21
ON SWITCH
ON SWITCH
OFF SWITCH
32
30
31
HIGH
TEMPERATURE
CIRCUIT
BREAKER
34
FLOW
SWITCH
35

COMBINATION CLEANER SAFETY CIRCUIT

CROSS-REFERENCE TO RELATED APPLICATION

This application is a continuation-in-part of copending application Ser. No. 498,457, filed May 26, 1983 now U.S. Pat. No. 4,552,162.

TECHNICAL FIELD

The present invention relates generally to pressure cleaning systems, and more particularly to a control safety circuit for a combination steamer and washer which incorporates predetermined automatic time delays on start-up and shutdown to minimize the possibility of temperature extremes and thus damage to the system without additional operator attention.

BACKGROUND ART

Pressurized steam cleaners and washers are utilized in a variety of situations for cleaning purposes. Such systems generally include a pair of tanks, one of which is for liquid cleanser or detergent and the other of which is for water. These tanks are connected to the inlet of a pump, usually through a mixer or aspirator which mixes the liquids in the desired ratios into a suitable cleaning solution, for discharge under pressure through the nozzle of a wand. Equipment of this type is controlled primarily by switching the pump on and then manipulating the wand as necessary to spray the object being cleaned.

Traditionally, such cleaning systems have utilized burners to heat the solution, however, such systems are best suited for applications where proper ventilation is available. Cleaning systems incorporating electrical heating elements have also been developed for use in hazardous areas such as grain elevators and the like, where a spark or open flame could trigger an explosion or fire. Such systems have been available from Sioux Steam Cleaner Corporation, the assignee hereof.

Although the electric cleaning systems of the prior art have functioned reasonably well, they have not been without certain difficulties. For example, purging of the air and priming of the system upon start-up are relatively timeconsuming in the systems of the prior art. This in turn can result in delays and erratic operation before the system is at full pressure. This can also cause flow discontinuities within the system which can result in overheating and damage to the equipment. In the case of cleaing systems with electrical heaters, it is especially important that the heating elements always be substantially immersed during operation to avoid uneven heating and thus premature burnout of the resistance elements. It is thus important to ensure that the entire system has been properly primed with liquid and purged of air to avoid possible overheating of the heating elements upon initial start-up, which in turn requires additional operator attention. Such cleaning systems are usually operated intermittently, and it will be appreciated that maintenance of adequate priming throughout the system has been a chronic problem. The parent application hereof to Sioux Steam Cleaner Corporation is directed to an electric combination cleaner which is adapted to effect complete and rapid priming of the system upon start-up, while being responsive to flow discontinuities which could damage the electrical heater elements. Although such cleaning systems can be designed to assure proper priming upon start-up, overheating can also occur upon shutdown or upon either start-up or shutdown if the system is operated improperly.

A need has thus arisen for a cleaner safety circuit by which certain control elements are automatically energized or de-energized after predetermined time delays to minimize the possibility of overheating upon start-up or shutdown, without reliance upon the operator.

SUMMARY OF INVENTION

The present invention comprises a combination cleaner safety circuit which overcomes the foregoing and other difficulties associated with the prior art. In accordance with the invention, there is provided a control circuit which incorporates a predetermined time delay before energization of the electrical heating elements in the heater tanks upon start-up to allow sufficient priming of the system, together with a predetermined time delay before de-energization of the pump upon shutdown for gradual cooling of the elements before the next cycle.

BRIEF DESCRIPTION OF DRAWINGS

A better understanding of the invention can be had by reference to the following Detailed Description in conjunction with the accompanying Drawing.

DETAILED DESCRIPTION

The entire specification of co-pending allowed parent application Ser. No. 498,457 filed May 26, 1983, now U.S. Pat. No. 4,552,162 is incorporated herein by reference.

The FIGURE is a detailed electrical schematic of the combination cleaner electrical control safety circuit of the present invention, which is adapted for use as an external safety circuit, as will be explained more fully hereinafter.

Electrical heating elements 10, 11 and 12 are disposed in the water heater tanks of the cleaner. Elements 10–12 are connected through a relay 13 to a three-phase 460 volt AC power supply. Relay 13 includes a magnetic coil 14 to control the opening and closing of the relay contacts.

A motor 15 is provided to drive the system pump P for circulating water through the heating chambers containing elements 10–12. A pump relay 16 connects motor 15 to the AC power supply, with magnetic coil 17 controlling the opening and closing of the relay contacts. An on-delay relay 18 is operatively coupled with relay 16 such that once relay 16 is closed, relay 18 will close after a predetermined delay, preferably about 8 minutes.

Because, as noted above, it is highly undesirable that elements 10–12 be energized when not immersed in water, the control safety circuit of the present invention assures that the elements are not activated in the absence of water. A first aspect of this control provides that elements 10–12 are not activated for a period of time following the activation of motor 15, so that the pump P has sufficient time to completely fill the heater tanks with water. Another aspect of the control circuit provides a flow switch mechanically interposed in the plumbing of the cleaner such that, in the absence of water flow through the heater tanks, elements 10–12 are deactivated. Another aspect of the control circuit provides that motor 15 remain activated for a period of time following the shutdown of elements 10–12 in order that overheating of the water in the heater tanks, and consequently the overheating of the heating elements themselves be avoided by gradual cooling.

Under normal circumstances emergency shutdown switch 20 and high pressure limit circuit breaker 21 are each closed, providing a connection between one pole of transformer 22 to a first terminal of start switch 30 and stop switch 31. The other terminal of start switch 30 is connected through off-delay relay 40 to magnetic coil 17 of relay 16. The other terminal of stop switch 31 connects to one terminal of start switch 32, the other terminal of which is connected through on-delay relay 18, high temperature circuit breaker 34, and flow switch 35 to magnetic coil 14 of relay 13. The other terminal of start switch 32 is further connected to the coil 37 of off-delay relay 40.

To start the system, push button switches 30 and 32 may be actuated simultaneously (either one first, however). Closing start switch 32 energizes off-delay relay 40 and one terminal of on-delay relay 18. With off-delay relay 40 energized, actuating start switch 30 energizes magnetic coil 17 and thus relay 16, starting motor 15 and initiating the time delay period of on-delay relay 18. After the time delay, relay 18 closes, whereby magnetic coil 14 may energize relay 13 (provided that breaker 34 and switch 35 are closed) thereby delivering power to heating elements 10–12 in the heater tanks. Accordingly, as can be seen upon inspection, heating elements 10–12 may not be energized unless motor 15 is energized, and then again not until a predetermined period of time, preferably about 8 minutes, after that.

During normal operation power is continuously applied to heating elements 10–12. However, if the water flow through the heater tanks is disrupted, or if the temperature of elements 10–12 exceeds a predetermined level, the coil 14 of relay 13 may be de-energized via the opening of either high temperature breaker 34 or flow switch 35. However, it shall be seen that the opening of either breaker 34 or switch 35 does not interrupt the operation of motor 15 and the pump, such that whatever flow is available to carry heat away from heating elements 10–12 and thus reduce the possibility of damage to them will be continued. Emergency shutdown switch 20 or high pressure limit switch 21 will, however interrupt power to both heating elements 10–12 and the pump motor 15. Emeregency shutdown switch 20 is manually operated, while high pressure limit circuit breaker 21 is responsive to the pressure within the heating chambers in order to interrupt power to the cleaner when abnormally high pressures are sensed.

Normal system deactivation is accomplished by opening stop switch 31, which is turn opens the circuit to start switch 32. As a result, off-delay relay 40 is deactivated, such that the relay then remains closed for a delay period, preferably about 8 minutes, before opening. As may be seen, during the delay period, power continues to be applied via the relay to relay 16, thus keeping pump motor 15 energized for the 8-minute period. Power to heater elements 10–12 is cut off immediately, however, wherein water continues to be circulated past the elements for a period of time during their cool-down period.

From the foregoing, it will thus be apparent that the present invention comprises a combination cleaner control circuit having numerous advantages over the prior art. The system herein provides predetermined automatic time delays upon start-up and shutdown as a safety circuit to avoid overheating and thus possible damage. Other advantages will be evident to those skilled in the art.

Although particular embodiments of the invention have been illustrated in the accompanying Drawing and described in the foregoing Detailed Description, it will be understood that the invention is not limited only to the embodiments disclosed, but is intended to embrace any alternatives, equivalents, modifications and/or rearrangements of elements falling within the scope of the invention as defined by the following claims.

What is claimed is:

1. A steam cleaner, comprising:

a water heating chamber;

electrical heating elements disposed in said heating chamber an electrical pump for circulating water through said heating chamber;

means for selectively supplying electrical energy to said elements and said pump including:

a pump relay having a coil;

an element relay having a coil;

an on-time delay relay operative to close a predetermined time interval after said pump relay closes;

an off-time delay relay having a coil and being operative to open a predetermined time interval after its coil is de-energized;

a pressure-sensitive circuit breaker located in said cleaner to sense dangerously high pressures;

a first on-switch connected on one side to a source of electrical energy through said pressure-sensitive circuit breaker and on the other side to one side of said off-time delay relay, the other side of said off-time delay relay being connected to the coil of said pump relay;

a second on-switch having two sides;

an off-switch connected on its one side to said one side of said first on-switch and on the other side to one side of said second on-switch, said second on-switch being connected on its other side to one side of said on-time delay relay and to the coil of said off-time delay relay whereby closing said second on-switch energizes said pump and closes said off-time delay relay; and a flow-switch and a heat-sensitive circuit breaker connected in series between said on-time delay relay and the coil of said element relay, said flow switch being mounted in said cleaner to detect and close in response to the flow of water through said water heating chamber, said heat-sensitive circuit breaker mounted proximate said heating elements and operative in response to temeperatures in excess of a desired threshold to open;

whereby said means for selectively supplying electrical energy to said elements and pump prevents said heating elements from being energized prior to the filling of said heating chamber with water, and whereby said pump is maintained in operation for a predetermined time following the de-energizing of the heating elements as accomplished by operating said off-switch.

2. A steam cleaner, comprising:

a water heating chamber;

an electrical heating element disposed in said heating chamber;

an electrical pump for circulating water through said heating chamber;

means including a pump relay and an element relay for selectively supplying electrical energy to said heating element and to said pump;

an on-time delay relay operative to close a predetermined time interval after closing of said pump relay;

an off-time delay relay operative to open a predetermined time interval after its coil is de-energized;

a first on-switch connected on one side to a source of electrical energy and connected on the other side to one side of said off-time delay relay, the other side of said off-time delay relay being connected to said pump relay;

a second on-switch; and an off-switch connected on one side to said one side of said first on-switch and connected on the other side to one side of said second on-switch, said second on-switch being connected on its other side to one side of said on-time delay relay and to said off-time delay relay whereby closing said second on-switch energizes said electrical pump and closes said off-time delay relay;

whereby energization of said electrical heating element upon actuation of said on-switches is delayed by said on-time delay relay, and deenergization of said electrical pump upon actuation of said off-switch is delayed by said off-time delay relay, to avoid overheating of the cleaner.

3. The steam cleaner of claim 2, wherein said on-time delay relay closes about eight minutes after actuation of said on-switches.

4. The steam cleaner of claim 2, wherein said off-time delay relay opens about eight minutes after actuation of said off-switch.

5. The steam cleaner of claim 2, further including:

a pressure sensitive circuit breaker and an emergency shut-down switch connected in series between said first on-switch and the source of electrical energy, said pressure sensitive circuit breaker being operative to open in response to pressures in the cleaner beyond a predetermined threshold.

6. The steam cleaner of claim 2, further including:

a flow switch and heat sensitive circuit breaker connected in series between said on-time delay relay and a coil of said element relay, said flow switch being operative to close in response to flow of water through said heating chamber, and said heat-sensitive circuit breaker being operative to open in responsive to temperatures beyond a predetermined temperature level in the cleaner.

7. A control safety circuit for a steam cleaner including an electrical pump for circulating water through a chamber containing an electrical heating element, said control circuit comprising:

a first on-switch connected on one side to a source of electrical energy;

a second on-switch;

an off-switch connected on one side to said one side of said first on-switch and connected on the other side to one side of said second on-switch;

an on-time delay connected between the other side of said second on-switch and said heating element, said on-time delay being operative to close a predetermined time interval after actuation of said on-switches; and an off-time delay relay connected between another side of said first on-switch and said pump, said off-time delay relay being operative to open a predetermined time interval after actuation of said off-switch and de-energization of the heating element.

* * * * *